US010889968B2

(12) United States Patent
Philipps et al.

(10) Patent No.: US 10,889,968 B2
(45) Date of Patent: Jan. 12, 2021

(54) FLUSH-MOUNTED BOX FOR A FITTING BODY

(71) Applicant: Grohe AG, Hemer (DE)

(72) Inventors: Hartwig Philipps, Menden (DE); Thomas Loi, Bad Segeberg (DE); Frank-Thomas Luig, Menden (DE)

(73) Assignee: Grohe AG, Hemer (DE)

( * ) Notice: Subject to any disclaimer, the term of this patent is extended or adjusted under 35 U.S.C. 154(b) by 11 days.

(21) Appl. No.: 16/513,161

(22) Filed: Jul. 16, 2019

(65) Prior Publication Data

US 2019/0338499 A1 Nov. 7, 2019

Related U.S. Application Data

(63) Continuation of application No. PCT/EP2018/050955, filed on Jan. 16, 2018.

(30) Foreign Application Priority Data

Jan. 16, 2017 (DE) ..... 10 2017 100 707

(51) Int. Cl.
*E03C 1/02* (2006.01)

(52) U.S. Cl.
CPC ..... *E03C 1/021* (2013.01)

(58) Field of Classification Search
CPC ..... E03C 1/021; E03C 1/023
USPC ..... 4/696
See application file for complete search history.

(56) References Cited

U.S. PATENT DOCUMENTS

2017/0002551 A1* 1/2017 Zhou ..... E03C 1/04
2018/0073223 A1* 3/2018 Colombo ..... E03C 1/021
2019/0003617 A1* 1/2019 Ismert ..... F16L 3/237

FOREIGN PATENT DOCUMENTS

DE 102008064253 B3 2/2010
DE 102013003823 A1 9/2014
DE 102014103713 B3 2/2015
EP 2468964 A1 6/2012
EP 2626484 A2 8/2013

OTHER PUBLICATIONS

International Search Report dated May 16, 2018 in corresponding application PCT/EP2018/050955.

* cited by examiner

*Primary Examiner* — Huyen D Le
(74) *Attorney, Agent, or Firm* — Muncy, Geissler, Olds & Lowe, P.C.

(57) ABSTRACT

A flush-mounted box for a fitting body having a housing, including a receiving chamber for the fitting body, the housing having at least one detent area; a fastening frame for fastening the flush-mounted box on a support, the fastening frame including at least one spring element, which may be engaged in the at least one detent area of the housing for fastening the fastening frame to the housing; and at least one clip for securing the at least one spring element in the at least one detent area of the housing.

10 Claims, 6 Drawing Sheets

FLUSH-MOUNTED BOX FOR A FITTING BODY

This nonprovisional application is a continuation of International Application No. PCT/EP2018/050955, which was filed on Jan. 16, 2018, and which claims priority to German Patent Application No. 10 2017 100 707.5, which was filed in Germany on Jan. 16, 2017, and which are both herein incorporated by reference.

BACKGROUND OF THE INVENTION

Field of the Invention

The present invention relates to a flush-mounted box for a fitting body, which is used to fasten the fitting body within a wall opening, a recess in a wall or another support. Flush-mounted boxes of this type have proven to be successful, in particular in wall panels and pre-wall systems.

Description of the Background Art

Flush-mounted boxes are regularly at least partially made from plastic and are inserted into the recess or the opening of a wall. They have a size which is dimensioned in such a way that the front edge of the flush-mounted box is flush with a front side of the wall. However, the front edge of the flush-mounted box is regularly too long or too short. After completing a tiling job, the installer then cuts off the still protruding portion of the flush-mounted box, using a knife or a cutting device, or an extension is attached, so that the front edge of the flush-mounted box extends up to the front side of the wall. However, this results in a great mounting complexity. Flush-mounted boxes having an adjustable fastening frame are also known, with the aid of which an extension of the flush-mounted box is avoidable. Bayonet joints, for example, are used to fix the fastening frame in a certain position on the housing of the flush-mounted box. To establish or release the bayonet joint between the fastening frame and the housing of the flush-mounted box, the installer must carry out a complex sequence of movements. This is awkward and time-consuming.

SUMMARY OF THE INVENTION

It is therefore an object of the present invention to at least partially solve the problems described with reference to the prior art and, in particular, to specify a flush-mounted box, whose fastening ring may be fastened to a housing of the flush-mounted box with little effort.

In an exemplary embodiment, the flush-mounted box for a fitting body includes a housing, including a receiving chamber for the fitting body, the housing having at least one detent area; a fastening frame for fastening the flush-mounted box on a support, the fastening frame including at least one spring element, which may be engaged in the at least one detent area for fastening the fastening frame to the housing; and at least one clip for securing the at least one spring element in the at least one detent area of the housing.

The flush-mounted box is used to mount a fitting body in a wall opening, a recess in a wall or the like. The fitting body may be, for example, a mixing valve, a mixer cartridge and/or a shutoff valve, or the fitting body may comprise components of this type. The flush-mounted box is used, in particular, for showers or bathtubs and is arranged in the area of a shower or bathtub for this purpose.

The flush-mounted box includes a housing having a receiving chamber for the fitting body. The fitting body may be at least partially arranged in the receiving chamber. The house is, in particular, at least partially made from plastic and/or, in particular, has an at least partially cylindrical or tubular design. The cylindrical or tubular area of the housing defines, in particular, a longitudinal direction of the flush-mounted box. However, the housing does not have to have a cylindrical outer contour, which is another advantage over a fastening frame fastened to the flush-mounted box with the aid of a bayonet joint. The housing has at least one detent area on an outer circumferential surface, which is used to fasten a fastening frame of the flush-mounted box.

The fastening frame may be designed, for example, in the manner of a flange or ring, which has, in particular, an opening whose diameter essentially corresponds to an outer diameter of the housing. The fastening frame may be mounted on the housing hereby. The fastening frame is used to fasten the flush-mounted box to a support. The support may be, for example, a wall or a post. The fastening frame furthermore includes at least one spring element, which may be engaged in the at least one detent area of the housing for the purpose of fastening the fastening frame to the housing. The at least one spring element is elastically adjustable and may preferably be engaged in the at least one detent area of the housing in a plurality of detent positions along the longitudinal direction of the flush-mounted box. Moreover, the fastening frame may have at least one hole, through which the fastening frame may be fastened to the support, for example with the aid of at least one screw.

The flush mounted box also includes at least one clip for securing the at least one spring element in the at least one detent area of the housing. With the aid of the clip, a deflection of the at least one spring element may be prevented after the engagement in the at least one detent area, so that the fastening frame is essentially unable to move relative to the housing or is no longer detachable from the housing. The at least one clip is used, in particular, for the form-fitting locking of the at least one spring element. Due to the at least one spring element and the at least one detent area, the fastening ring must be pushed only linearly onto the housing during the mounting on the housing and be secured in the at least one detent area with the aid of the clip. No additional rotational movement is necessary. The mounting of the flush-mounted box, in which limited visibility conditions regularly prevail, is made easier hereby.

It is also advantageous if the at least one detent area has at least one detent. The at least one detent is designed in such a way that the at least one spring element may engage with the at least one detent. The at least one detent is, in particular, a projection, which projects in a radial direction from the outer circumferential surface of the housing. The at least one detent may also have a triangular or another cross section.

In addition, it is advantageous if the at least one detent extends in a circumferential direction or tangentially to a circumferential surface of the housing. The at least one detent may extend in the circumferential direction of the housing or tangentially to the circumferential surface of the housing, for example by 3 mm (millimeters) to 50 mm. Moreover, the at least one detent area may have a plurality of detents situated side by side, for example 2 to 20 detents, in a longitudinal direction of the housing.

It is also advantageous if the at least one spring element is designed as a spring tongue. The spring tongue has a tongue base, with the aid of which the spring tongue is connected to the fastening frame, in particular in the area of the opening of the fastening frame. The spring tongue extends from the tongue base to an elastically deflectable tongue tip.

It is furthermore advantageous if the at least one spring element extends in a longitudinal direction of the housing and is deflectable in a radial direction of the housing. The deflection of the at least one spring element takes place, in particular, due to the engagement of the at least one detent area when the fastening frame is mounted on the housing. The deflection takes place due to an elastic deformation of the at least one spring element.

Moreover, it is advantageous if the at least one spring element includes at least one detent tab, which engages in the at least one detent area. The detent tab extends, in particular, radially to the inside. In particular, each spring element includes two detent tabs.

It is also advantageous if the fastening frame may be fastened with the aid of the at least one spring element in the at least one detent area of the housing in a plurality of positions in a longitudinal direction of the housing. In other words, the fastening frame has a plurality of detent positions relative to the housing in the longitudinal direction of the housing.

It is furthermore advantageous if the fastening frame may be mounted on the housing. The fastening frame has the opening into which the housing is insertable, for this purpose.

It is also advantageous if a deflection of the at least one spring element may be prevented with the aid of the at least one clip after the engagement in the at least one detent area. The at least one clip locks the at least one spring element for this purpose, in particular in a form-fitting manner.

The at least one clip is preferably movably supported on the fastening frame between a mounting position and a securing position. In particular, the at least one clip is movable between the mounting position and the securing position in the longitudinal direction of the housing. In the mounting position, the at least one spring element is released, so that it may be deflected in the longitudinal direction by the at least one detent of the at least one detent area during a movement of the fastening frame. Upon reaching the desired detent position of the fastening frame, the at least one clip may be moved out of the mounting position into the securing position, so that the at least one spring element is no longer deflectable and the fastening frame is thus secured in the corresponding detent position.

The invention as well as the technical field are explained in greater detail below on the basis of the figures. It should be noted that the figures illustrate a particularly preferred design variant of the invention but are not limited thereto. Identical components are provided with the same reference numerals in the figures. In an exemplary and schematic manner, Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
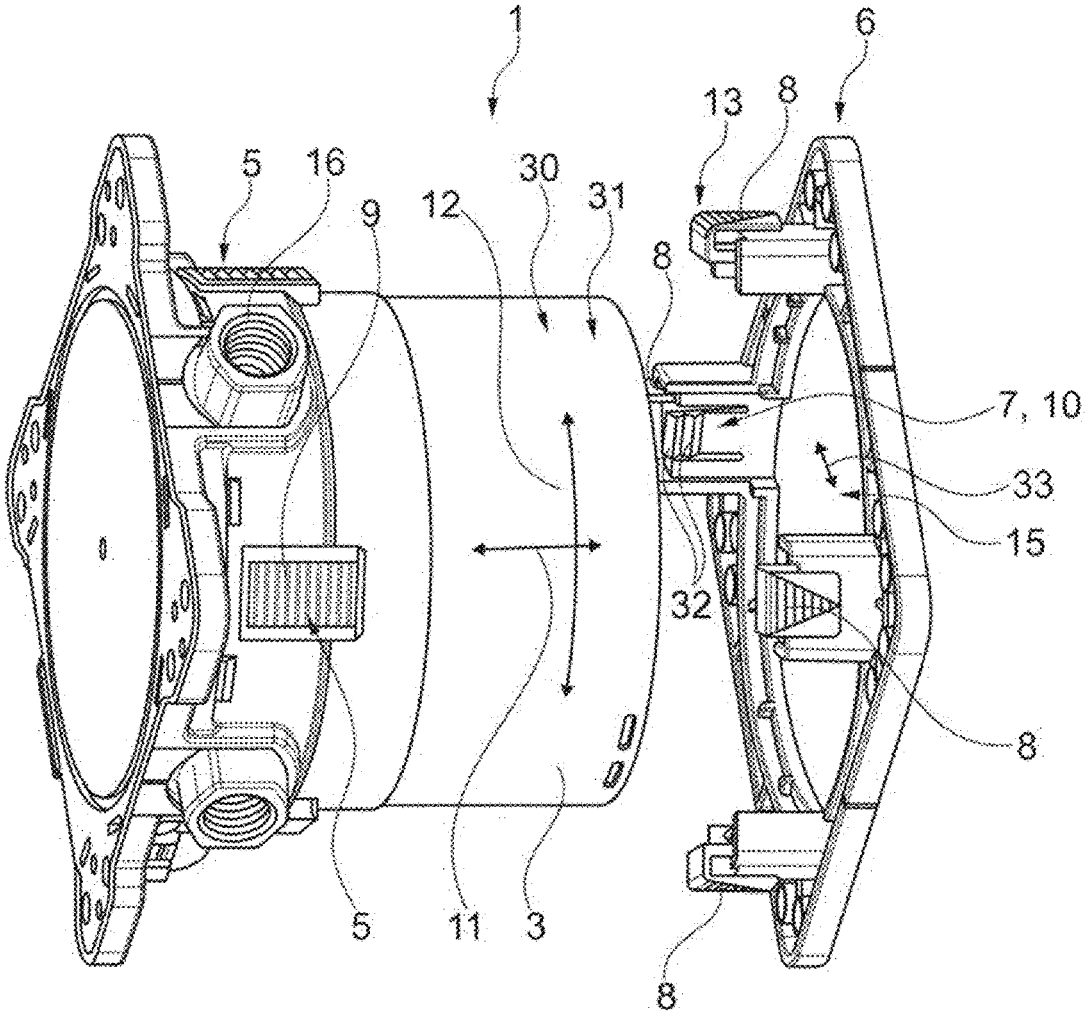
FIG. 1 shows a flush-mounted box before a fastening frame is mounted.

FIG. 1 shows a perspective view of a flush-mounted box 1 before a fastening frame 6 has been fastened to a housing 3 of flush-mounted box 1. Housing 3 has a tubular section 30, which defines a longitudinal direction 11 of flush-mounted box 1. A receiving chamber 4, which is not apparent here and in which a connecting ring 16 and a fitting body 2, not illustrated here, are arranged in housing 3. Housing 3 has four detent areas 5 on an outer circumferential surface 31, of which only two are apparent in FIG. 1. Detent areas 5 are disposed offset from each other in a circumferential direction 12 of housing 3. The detent areas also each include a plurality of detents 9, which are arranged adjacent to each other in longitudinal direction 11. Fastening frame 6 may be mounted on housing 3 of flush-mounted box 1 in longitudinal direction 11. For this purpose, fastening frame 6 has an opening 15, whose diameter essentially corresponds to an outer diameter of housing 3. Moreover, fastening frame 6 includes four spring elements 7, of which only one spring element 7 is apparent in FIG. 1. Spring elements 7 here are designed in the manner of spring tongues 10. Spring elements 7 extend in longitudinal direction 11. In addition, each spring element 7 includes two detent tabs 32, which extend inwardly in a radial direction 33. When fastening frame 6 is mounted on housing 3, spring elements 7 are deflected outwardly in radial direction 33 by detents 9 of detent areas 5 until one of detents 9 engages between the two detent tabs 32. In this position, spring elements 7 spring back inwardly in radial direction 33, so that fastening frame 6 is prefixed on housing 3. A clip 8 is assigned to each of spring elements 7, which is displaceably supported on fastening frame 6. Clips 8 here are in a mounting position 13, in which spring elements 7 are displaceable outwardly in radial direction 33 by detents 9 of detent areas 5.

Figure 2:
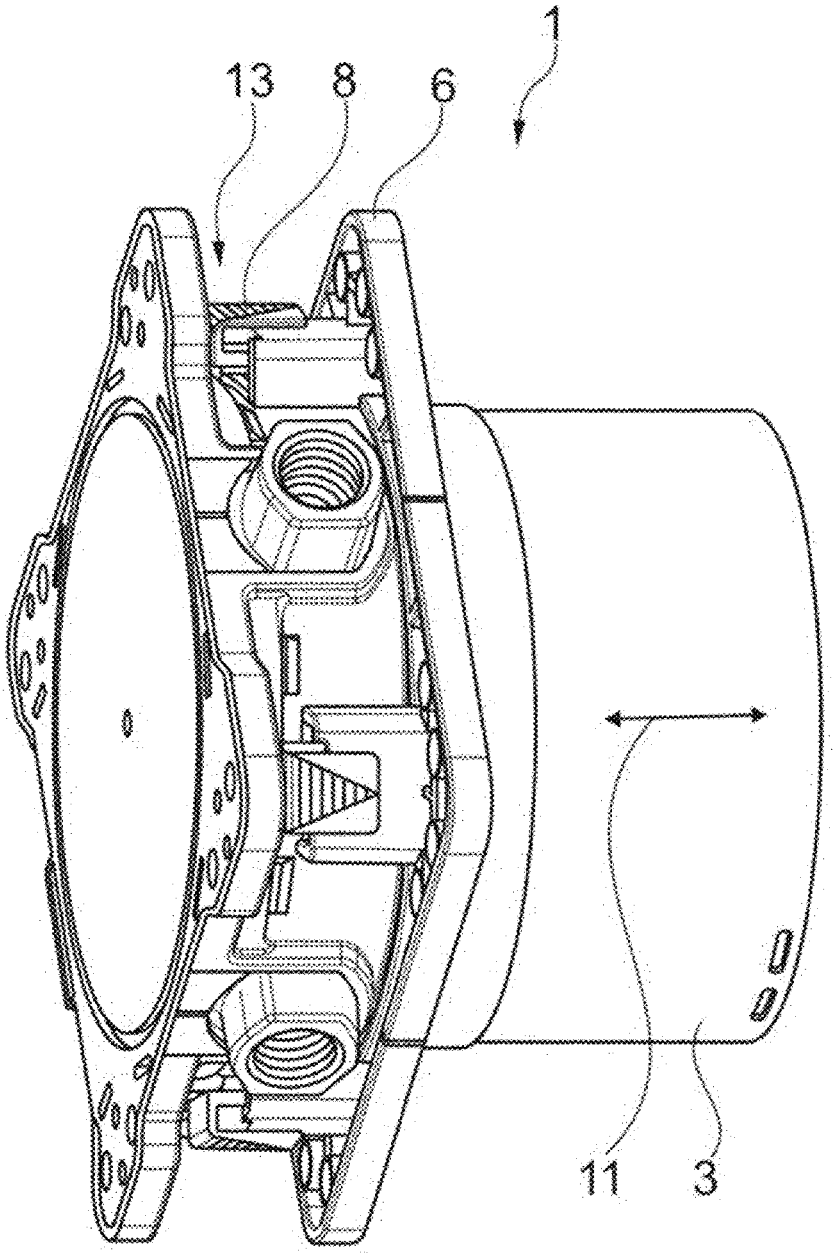
FIG. 2 shows a flush-mounted box after the fastening frame is mounted.

FIG. 2 shows flush-mounted box 1 after fastening frame 6 has been mounted on housing 3 in longitudinal direction 11. Spring elements 7, which are not apparent here, are engaged in detent areas 5 of housing 3. Clips 8 remain in mounting position 13, so that fastening frame 6 continues to be only prefixed on housing 3.

Figure 3:
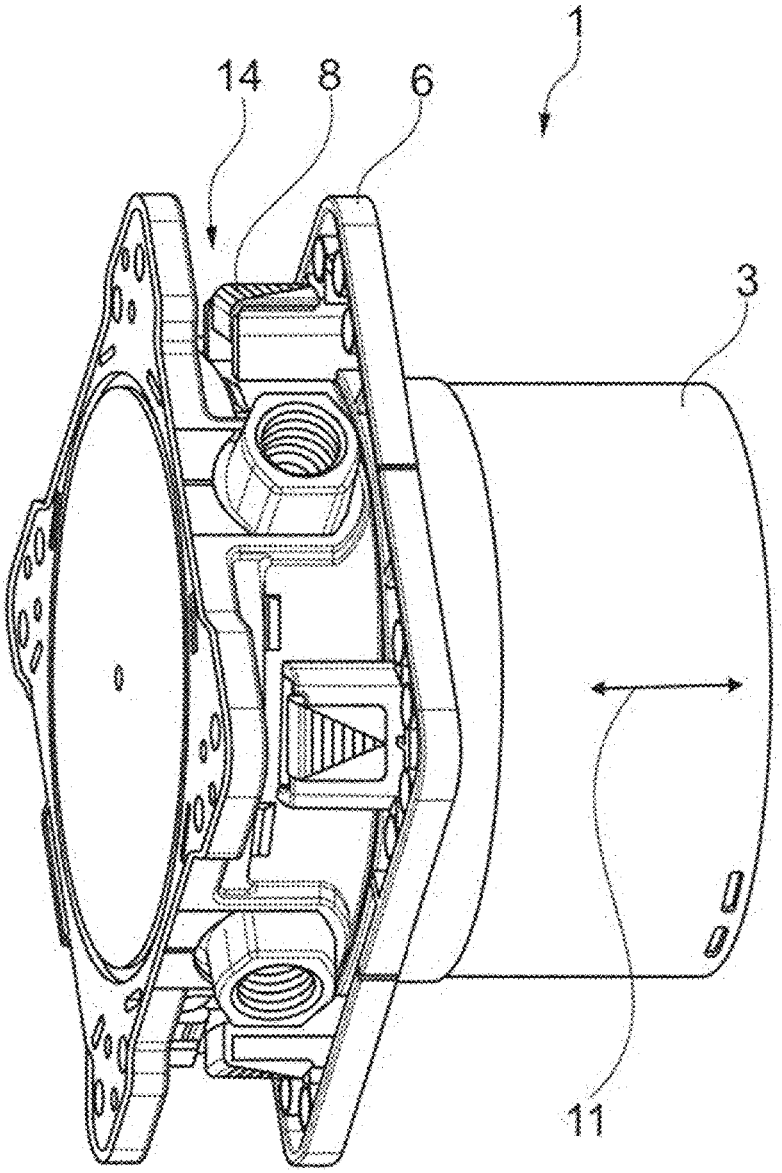
FIG. 3 shows a flush-mounted box after the fastening frame is secured.

FIG. 3 shows flush-mounted box 1 with fastening frame 6 mounted on housing 3 in longitudinal direction 11 after clips 8 have been moved from mounting position 13 shown in FIG. 2 in longitudinal direction 11 into securing position 14 shown in FIG. 3. In securing position 14, clips 8 prevent a deflection of spring elements 7, which are not illustrated here, so that fastening frame 6 is secured on housing 3.

Figure 4:
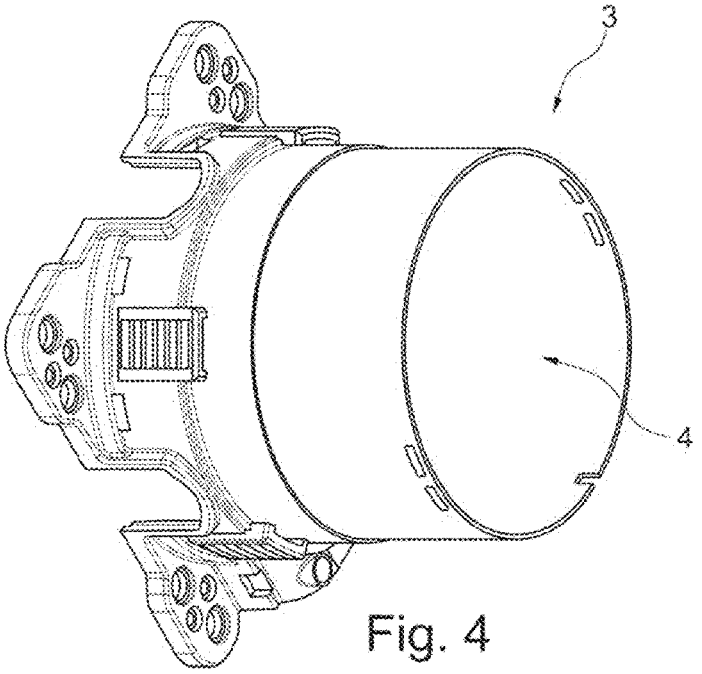
FIG. 4 shows a housing of the flush-mounted box.

FIG. 4 shows housing 3 of flush-mounted box 1 illustrated in FIGS. 1 through 3. Housing 3 has a receiving chamber 4 for a fitting body 2 illustrated in FIG. 8.

Figure 5:
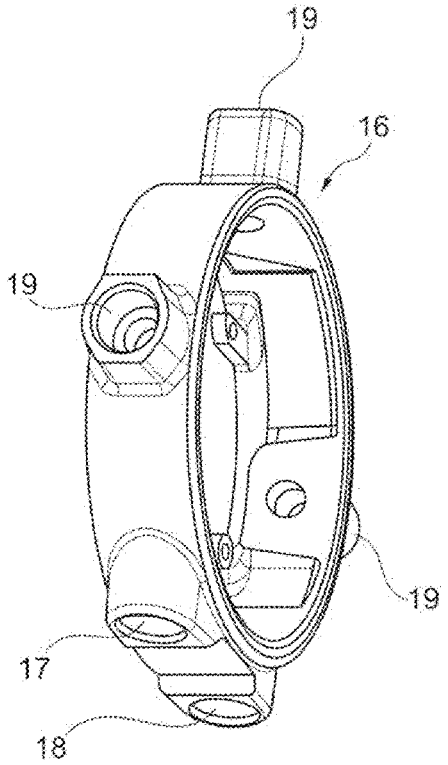
FIG. 5 shows a connecting ring of the flush-mounted box.

FIG. 5 shows connecting ring 16, previously apparent in FIG. 1, which has a hot water inlet 17 and a cold water inlet 18. The hot water flowing in via hot water inlet 17 and the cold water flowing in via cold water inlet 18 are mixable, with the aid of a mixing valve 23, illustrated in FIG. 8, to a mixed water, which is able to leave flush-mounted box 1 via three mixed-water outlets 19 of connecting ring 16.

Figure 6:
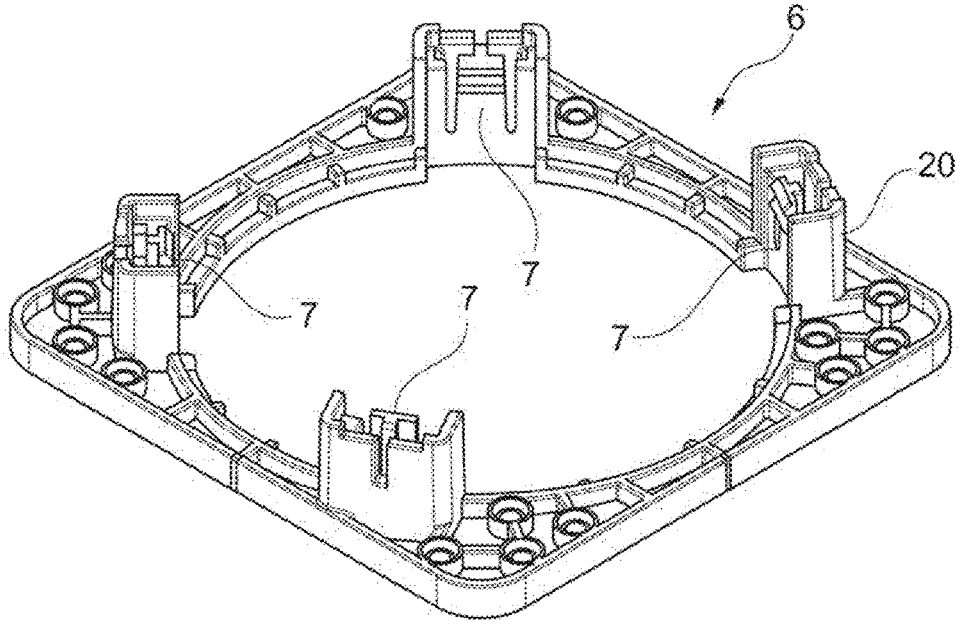
FIG. 6 shows the fastening frame of the flush-mounted box.

FIG. 6 shows fastening frame 6, including the four spring elements 7. The four spring elements 7 are each surrounded by a guide 20, into which clips 8 illustrated in FIG. 1 through 3 may be inserted and guided.

Figure 7:
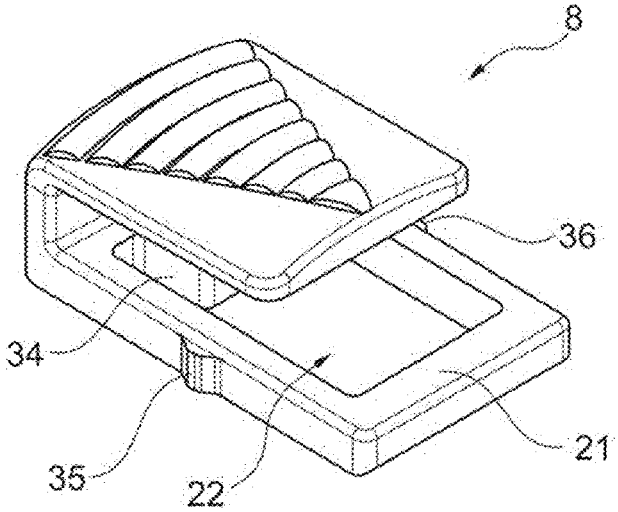
FIG. 7 shows a clip for securing the fastening ring on the housing.

FIG. 7 shows a perspective representation of one of clips 8. Clip 8 includes a frame 21 having a recess 22. In mounting position 13 of the clips illustrated in FIGS. 1 and 2, spring elements 7 illustrated in FIG. 6 are deflectable into recess 22. In securing position 14 of clip 8 illustrated in FIG. 3, a securing section 34 of clip 8 blocks spring elements 7 shown in FIG. 6, so that spring elements 7 are immovable. In addition, clip 8 includes a first cam 35 and a second cam 36 on frame 21, which snap into guide 20 in mounting position 13 illustrated in FIG. 2, so that clip 8 is unable to independently detach from fastening frame 6.

Figure 8:
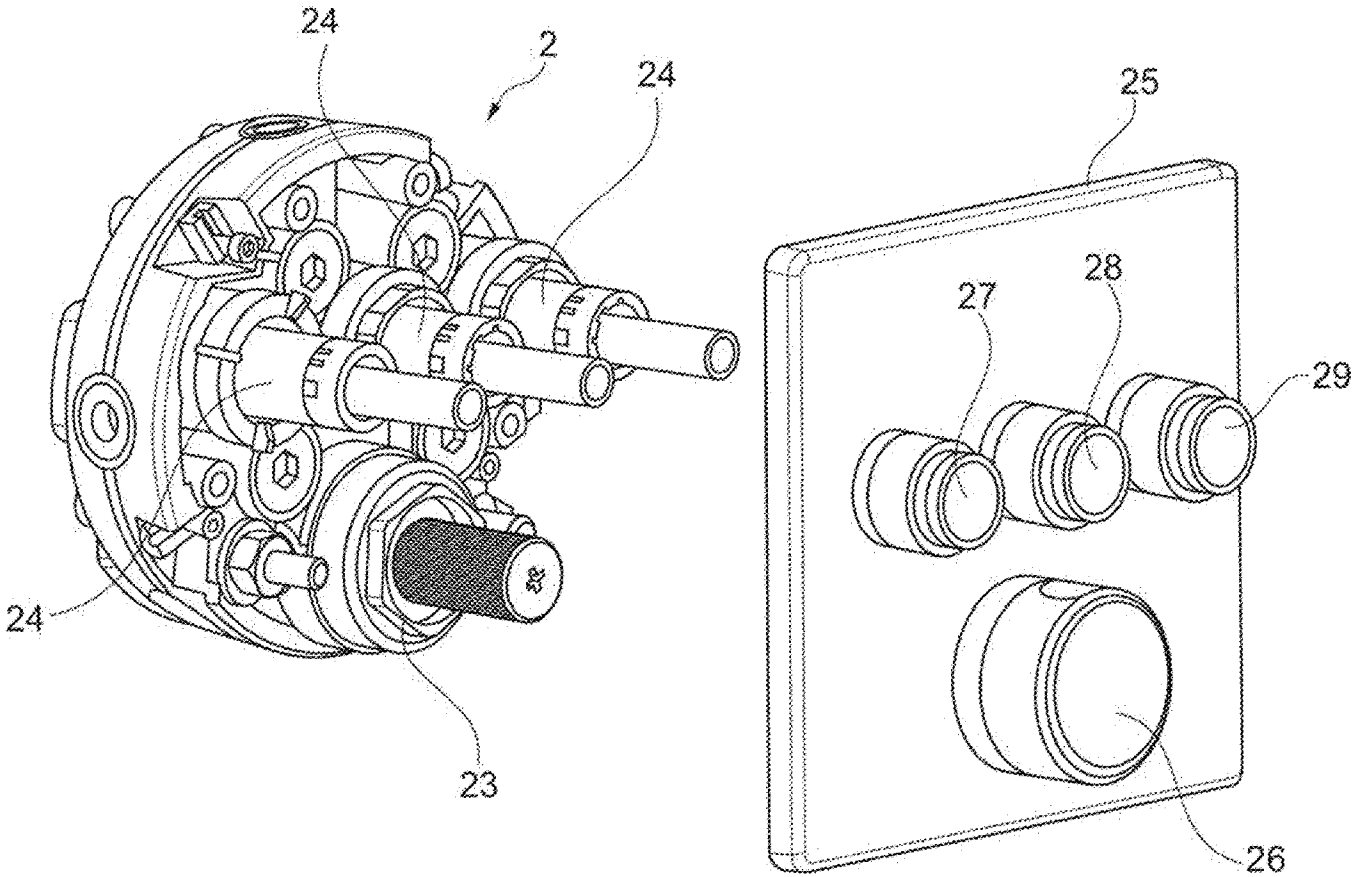
FIG. 8 shows a fitting body of the flush-mounted box.

FIG. 8 shows a fitting body 2, including a mixing valve 23, with the aid of which the hot water and the cold ware are mixable to a mixed water. Fitting body 2 also includes three shutoff valves 24, with the aid of which the outflow of the mixed water via the three mixed-water outlets 19 of connecting ring 16 shown in FIG. 5 are controllable. Mixing valve 23 may be actuated via a first adjusting element 26, and the three shutoff valves 24 may be actuated via a second adjusting element 27, a third adjusting element 28 and a fourth adjusting element 29. Adjusting elements 26, 27, 28, 29 are arranged on a panel 25, which is used as a cover for flush-mounted box 1 illustrated in FIGS. 1 through 3.

Due to the present invention, a fastening frame 6 may be fastened to a housing 3 of a flush-mounted box 1 with particularly minimal mounting complexity.

The invention being thus described, it will be obvious that the same may be varied in many ways. Such variations are not to be regarded as a departure from the spirit and scope of the invention, and all such modifications as would be obvious to one skilled in the art are to be included within the scope of the following claims

What is claimed is:

1. A flush-mounted box for a fitting body, comprising:

a housing including a receiving chamber for the fitting body, the housing having at least one detent area;

a fastening frame for fastening the flush-mounted box on a support, the fastening frame including at least one spring element, which may be engaged in the at least one detent area of the housing for fastening the fastening frame to the housing; and at least one clip for securing the at least one spring element in the at least one detent area of the housing.

2. The flush-mounted box according to claim 1, wherein the at least one detent area has at least one detent.

3. The flush-mounted box according to claim 1, wherein the at least one detent extends in a circumferential direction or tangentially to a circumferential surface of the housing.

4. The flush-mounted box according to claim 1, wherein the at least one spring element is a spring tongue.

5. The flush-mounted box according to claim 1, wherein the at least one spring element extends in a longitudinal direction of the housing and is deflectable in a radial direction of the housing.

6. The flush-mounted box according to claim 1, wherein the at least one spring element includes at least one detent tab, which engages in the at least one detent area.

7. The flush-mounted box according to claim 1, wherein the fastening frame is fastened in a plurality of positions in a longitudinal direction of the housing with the aid of the at least one spring element in the at least one detent area of the housing.

8. The flush-mounted box according to claim 1, wherein the fastening frame is mounted on the housing.

9. The flush-mounted box according to claim 1, wherein a deflection of the at least one spring element is prevented with the aid of the at least one clip after the engagement with the at least one detent area.

10. The flush-mounted box according to claim 1, wherein the at least one clip is movably supported on the fastening frame between a mounting position and a securing position.

* * * * *